United States Patent [19]

Tanaka et al.

[11] 4,292,938

[45] Oct. 6, 1981

[54] INTERNAL COMBUSTION ENGINE

[75] Inventors: Toshiaki Tanaka, Fujisawa; Yukihiro Etoh, Yokohama, both of Japan

[73] Assignee: Nissan Motor Company, Limited, Yokohama, Japan

[21] Appl. No.: 100,747

[22] Filed: Dec. 6, 1979

[30] Foreign Application Priority Data

Dec. 8, 1978 [JP] Japan ..... 53-169278

[51] Int. Cl.[3] ..... F02D 17/03; F02M 25/06

[52] U.S. Cl. ..... 123/198 F; 123/568

[58] Field of Search ..... 123/198 F, 568, 198 DB

[56] References Cited

U.S. PATENT DOCUMENTS

| | | | |
|---|---|---|---|
| 4,192,278 | 3/1980 | Iizuka et al. | 123/198 F |
| 4,204,514 | 5/1980 | Ishida | 123/198 F |
| 4,231,338 | 11/1980 | Sugasawa et al. | 123/198 F |
| 4,242,997 | 1/1981 | Kohama et al. | 123/568 |
| 4,249,374 | 2/1981 | Sugasawa et al. | 123/198 F |

*Primary Examiner*—P. S. Lall

*Attorney, Agent, or Firm*—Schwartz, Jeffery, Schwaab, Mack, Blumenthal & Koch

[57] ABSTRACT

An internal combustion engine is disclosed which includes a plurality of cylinders split into first and second groups, an intake passage provided therein with a throttle valve and bifurcated downstream of the throttle valve into first and second branches, the first branch communicating with the first group of cylinders, the second branch communicating with the second group of cylinders, and an EGR passage for recirculation of exhaust gases into the second branch. The second branch is provided therein with a stop valve and the EGR passage is provided therein with an EGR valve. Control means is provided for causing the EGR valve to open gradually after the stop valve is closed when the engine is shifted from its full cylinder mode to its split cylinder mode and for holding the stop valve open until the pressure in the second branch falls to a level equal to that in the first branch when the engine is shifted from its split cylinder mode to its full cylinder mode.

8 Claims, 4 Drawing Figures

INTERNAL COMBUSTION ENGINE

BACKGROUND OF THE INVENTION

1. Field of the Invention

This invention relates to a split type internal combustion engine including a plurality of cylinders split into two groups and operating in a split cylinder mode where one group of cylinders is supplied with fuel and fresh air and held operative and the other group of cylinders is supplied with neither fuel nor fresh air and held inoperative when the engine is under low load conditions.

2. Description of the Prior Art

Generally, internal combustion engines exhibit higher fuel combustion and thus higher fuel economy when running under higher load conditions. In view of this fact, split type internal combustion engines have already been proposed as automotive vehicle engine or the like which are subjected to frequent engine load variations. Such split type internal combustion engines are designed to have a plurality of cylinders split into first and second groups which communicate with the intake passage through first and second separated intake manifolds, respectively. Under low load conditions, the first group of cylinders is supplied with fuel and fresh air and held operative while the second group of cylinders is supplied with neither fuel nor fresh air and held inoperative to increase relative loads on the first group of cylinders for high fuel economy. In addition, exhaust gases are re-introduced into the second intake manifold to suppress pumping loss in the second group of cylinders for further high fuel economy.

One difficulty with such split type engines is that a portion of the exhaust gases re-introduced and present in the second intake manifold during a split cylinder mode of operation, flow into the first intake manifold to spoil fuel combustion in the first group of cylinders when the engine is shifted from its split cylinder mode to its full cylinder mode. Additionally, a portion of exhaust gases re-introduced into the second intake manifold flows into the first intake manifold to spoil fuel combustion in the first group of cylinders temporarily when the engine is shifted from its full cylinder mode to its split cylinder mode.

SUMMARY OF THE INVENTION

It is therefore one object of the present invention to provide an improved split type internal combustion engine which can eliminate the above described disadvantages found in conventional split engines.

Another object of the present invention is to provide an improved split type internal combustion engine which will be free from any fuel combustion trouble leading to a fuel economy penalty when the engine is shifted between its full and split cylinder modes of operation.

Other objects, means, and advantages of the present invention will become apparent to one skilled in the art thereof from the following description.

DESCRIPTION OF THE PREFERRED EMBODIMENT

Figure 1:
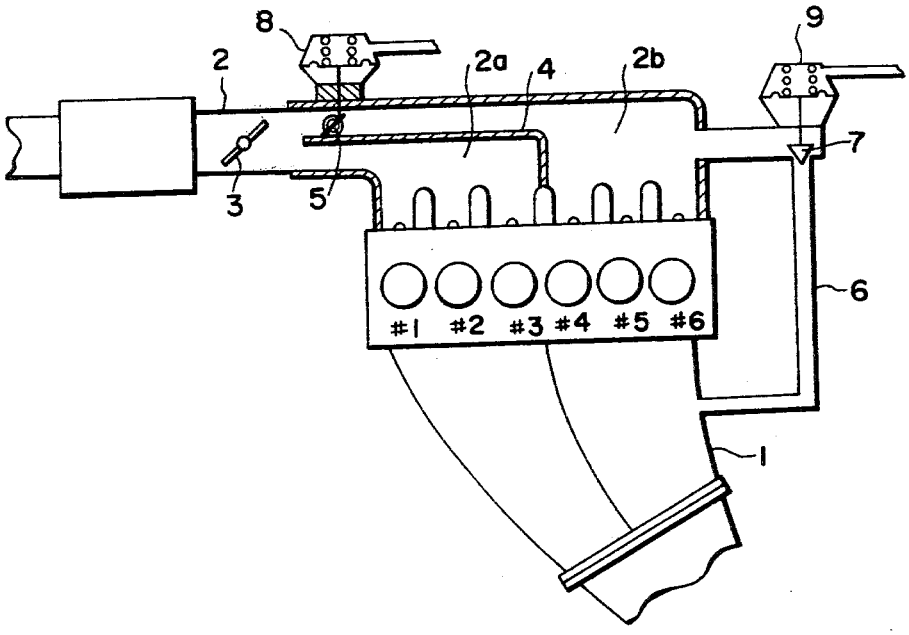
FIG.1 PRIOR ART
FIG. 1 is a schematic sectional view showing a conventional split type internal combustion engine.

Prior to the description of the preferred embodiment of the present invention, we shall briefly described the prior art split type internal combustion engine in FIG. 1 in order to specifically point out the difficulties attendant thereon.

Referring to FIG. 1, the conventional split type engine has a plurality of cylinders split into first and second groups of cylinders and operable in a full cylinder mode under high load conditions where all of the cylinders are supplied with fuel and fresh air and held operative and in a split cylinder mode under low load conditions where the first group of cylinders #1 to #3 are supplied with fuel and fresh air and held operative while the second group of cylinders are supplied with neither fuel nor fresh air and held inoperative. The engine comprises an exhaust passage 1, and an intake passage 2 provided therein with a throttle valve 3 and divided, by a partition 4 extending downstream of the throttle valve 3, into first and second branches **2*a* and 2*b*. The first branch 2*a* communicates with the first group of cylinders #1 to #3 and the second branch 2*b* communicates through a butterfly type stop valve 5 with the second group of cylinders #4 to #6. An exhaust gas recirculation (EGR) passage 6 is provided which has its one end opening into the exhaust passage 1 and the other end opening into the second branch 2*b*. The EGR passage 6 is provided therein with an EGR valve 7 for opening and closing the EGR passage 6. The stop valve 5 is operated by a first valve actuator 8 and the EGR valve 7 is operated by a second valve actuator 9**.

The first and second valve actuators 8 and 9 are simultaneously operated dependent upon engine load conditions. During a split cylinder mode of operation, the EGR valve 7 is fully open to allow re-introduction of exhaust gases into the second branch **2*b* so as to suppress pumping loss in the second group of cylinders #4 to #6, whereas the stop valve 5 is fully closed to prevent fresh air from flowing into the second branch 2*b* and also exhaust gases from flowing into the first branch 2*a* from the second branch 2*b*. During a full cylinder mode, the stop valve 5 is fully open to allow fresh air to flow into the second branch 2*a* and the EGR valve 7** is fully closed to prevent exhaust gas recirculation.

With such a conventional split type internal combustion engines, however, when the engine is shifted from a split cylinder mode to a full cylinder mode, a portion of the exhaust gases present in the second branch **2*b* during the split cylinder mode of operation flows into the first branch 2*a*, which is held at a higher vacuum, through the stop valve 5 to spoil fuel combustion in the first group of cylinders #1 to #3. Additionally, when the engine is shifted from a full cylinder mode to a split cylinder mode, a portion of recirculated exhaust gases temporarily flow through the stop valve 5 into the first branch 2*a* to spoil fuel combustion in the first group of cylinders #1 to #3**.

Figure 2:
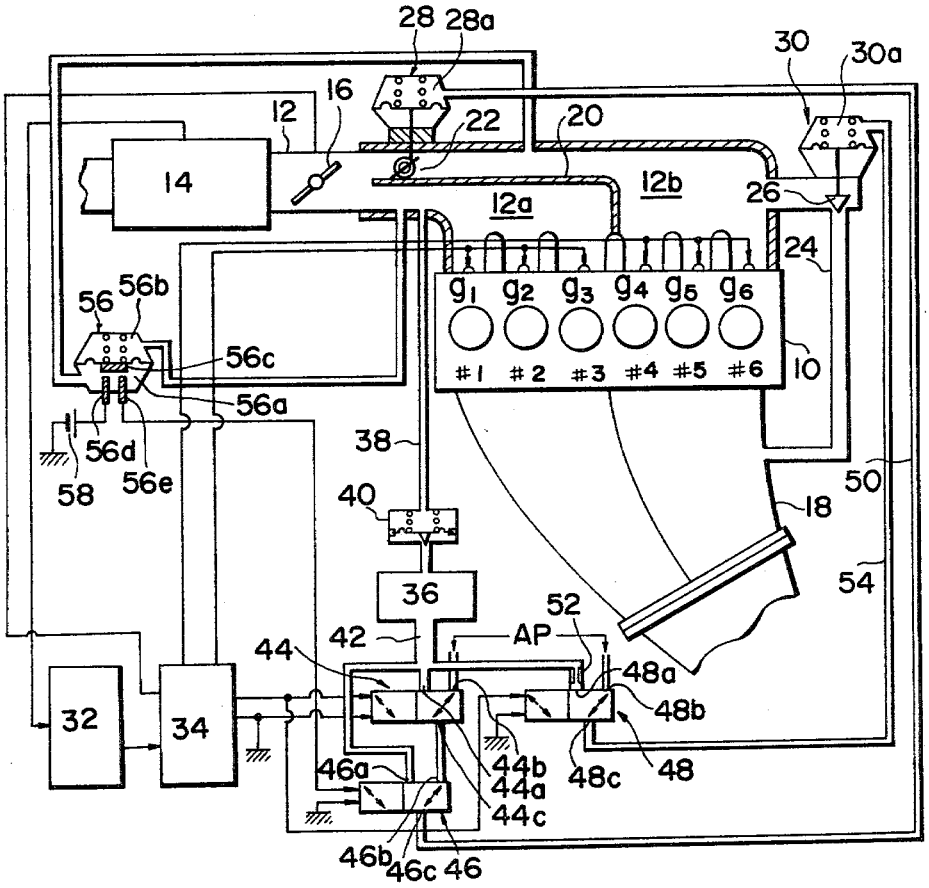
FIG. 2 is a schematic sectional view showing one embodiment of a split type internal combustion engine made in accordance with the present invention.

Referring now to FIG. 2, there is illustrated on embodiment of a split type internal combustion engine made in accordance with the present invention. The engine comprises an engine body 10 containing a plurality of cylinders (in the illustrated case 6 cylinders #1 to

#6) split into first and second groups, an intake passage 12 provided therein with an intake airflow sensor 14 and a throttle valve 16, and an exhaust passage 18. The intake passage 12 is divided, by a partition 20 extending downstream of the throttle valve 16, into first and second branches 12*a* and 12*b*, the first branch 12*a* communicating with the first group of cylinders #1 to #3 and the second branch 12*b* communicating with the second group of cylinders #4 to #6. A butterfly type stop valve 22 is provided at the entrance of the second branch 12*b* for opening and closing it. An EGR passage 24 is provided which has its one end opening into the exhaust passage 18 and the other end opening into the second branch 12*b*. The EGR passage 24 is provided therein with an EGR valve 26 for opening and closing the EGR passage 24.

The stop valve 22 is operated by a first valve actuator 28 and the EGR valve 26 is operated by a second valve actuator 30. The first valve actuator 28 comprises a diaphragm positioned within a casing to divide it so as to form a vacuum working chamber 28*a*, means drivingly connecting the diaphragm to the stop valve 22, and a balance spring provided within the vacuum working chamber 28*a* for urging the diaphragm in the direction to cause the stop valve 22 to open the second branch 12*b*. The first valve actuator 28 causes the stop valve 22 to open the second branch 12*b* when atmospheric pressure is conducted to its working chamber 28*a* and to close the same under the vacuum developed in its working chamber 28*a*. The second valve actuator 30 comprises a diaphragm positioned within a casing to divide it so as to form a vacuum working chamber 30*a*, means drivingly connecting the diaphragm to the EGR valve 26, and a balance spring provided within the working chamber 30*a* for urging the diaphragm in the direction to cause the EGR valve 26 to close the EGR passage 24. The second valve actuator 30 causes the EGR valve 26 to close the EGR passage 24 when atmospheric pressure is conducted to its working chamber 30*a* and to open the same under the vacuum developed in its working chamber 30*a*.

An electronic fuel injection control circuit 32 is provided which has an input from the intake airflow sensor 14 for providing, in synchronism with rotation of the engine, a drive pulse signal of pulse width varying in accordance with the amount of air introduced into the engine. The drive pulse signal is applied to a detector circuit 34 which is responsive to the degree of opening of the throttle valve 16 for detecting whether the engine is under low or high load conditions. Under high load conditions, the detector circuit 34 permits the passage of the drive pulse signal from the fuel injection control circuit 32 to all of fuel injection valve $g_1$ to $g_2$ for supplying fuel into the respective cylinders #1 to #6. Under low load conditions, the detector circuit 34 permits the passage of the drive pulse signal to the first group of fuel injection valves $g_1$ to $g_3$, but blocks the drive pulse signal to the second group of fuel injection valves $g_4$ to $g_6$. In addition, the detector circuit 34 provides a high output under high load conditions and a low output under low load conditions.

A vacuum tank 36 is provided which has one opening connected through a vacuum conduit 38 to the first branch 12*a* of the intake passage 12. The vacuum conduit 38 is provided therein with a check valve 40 which is open to allow conduction of the vacuum developed in the first branch 12*a* to the vacuum tank 36 when the first branch vacuum is higher than the vacuum tank vacuum and which is closed to disconnect the vacuum tank 36 from the first branch 12*a* when the second branch vacuum is lower than the vacuum tank vacuum. Thus, the vacuum tank vacuum can be held higher than the first branch vacuum. The other opening of the vacuum tank 36 is connected through a trifurcated vacuum conduit 42 to the first openings 44*a*, 46*a* and 48*a* of first, second and third three-way solenoid valves 44, 46 and 48 respectively.

Figure 3:
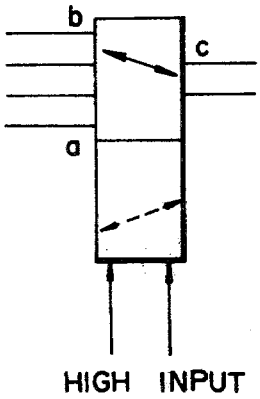
FIGS. 3 and 4 are schematic view used to explain the operation of three-way solenoid valves incorporated in the internal combustion engine of the present invention.
Figure 4:
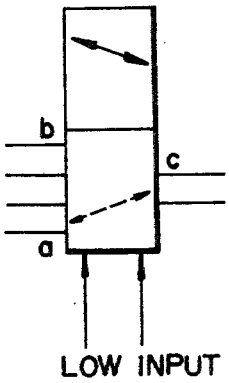

The first solenoid valve 44 has a second opening 44*b* connected to atmospheric pressure and a third opening 44*c* connected to the second opening 46*b* of the second solenoid valve 46 which has a third opening 46*c* connected through a conduit 50 to the working chamber 28*a* of the first valve actuator 28. An orifice 52 is provided in the trifurcated conduit branch leading to the first opening 48*a* of the third solenoid valve 48 which has a second opening 48*b* connected to atmospheric pressure and a third opening 48*c* connected through a conduit 54 to the working chamber 30*a* of the third valve actuator 30. Each of the first and second solenoid valves 44 and 48 is responsive to a high input from the detector circuit 34 for making a connection between its second and third openings b and c as indicated by the solid arrows in FIG. 3 and is responsive to a low input therefrom for making a connection between its first and third openings a and c as indicated by the broken arrows in FIG. 4.

A vacuum operated switch 56 is provided which comprises a diaphragm positioned within a casing to divide it into first and second vacuum working chambers 56*a* and 56*b*, the first chamber 56*a* connected to the second branch 12*b* downstream of the stop valve 22, the second chamber 56*b* connected to the first branch 12*a*, and a balance spring provided within the second working chamber 56*b* for urging the diaphragm toward the first working chamber 56*a*. The vacuum operated switch 56 also comprises a movable contact 56*c* mounted on the surface of the diaphragm facing the first working chamber 56*a*, and a pair of spaced-apart fixed contacts 56*d* and 56*e*. The fixed contact 56*d* is connected to the positive terminal of a DC power source 58 having its negative terminal grounded and the fixed contact 56*e* is connected to one of the control terminals of the second solenoid valve 46 having the other control terminal grounded. Thus, the vacuum operated switch 56 is turned on to conduct a high signal to the control terminal of the second solenoid valve 46 which thereby makes a connection between its second and third openings 46*b* and 46*c* when the pressure developed in the second branch 12*b* is equal to that in the first branch 12*a*, whereas it is turned off to hold the control terminal of the second solenoid valve 46 low to cause the second solenoid valve 46 to make a connection between its first and second openings 46*a* and 46*c* when the pressure developed in the second branch 12*b* is higher than that in the first branch 12*a*.

The operation of the present invention is best understood from following: During a full cylinder mode of operation, the first and third solenoid valve 44 and 48 are supplied with a high signal from the detector circuit 34 to connect the second openings 44*b* and 48*b* to the third openings 44*c* and 48*c*, respectively. Since the pressure developed in the second branch 12*b* is equal to that in the first branch 12*a*, the second solenoid valve 46 is supplied with a high signal to connect its second opening 46*b* to its third opening 46*c*. As a result, atmospheric pressure is conducted through the third solenoid valve 48 and the conduit 54 to the working chamber 30*a* of the second valve actuator 30 to cause the EGR valve 26 to close the EGR passage 24 so as to prevent recirculation of exhaust gases into the second branch 12*b*, and also is conducted through the first and second solenoid valves 44 and 46 and the conduit 50 to the working to the working chamber 28*a* of the first valve actuator 28 to cause the stop valve 22 to open the second branch 12*b* so as to allow fresh air to flow into the second group of cylinders.

When the engine is shifted from a full cylinder mode to a split cylinder mode, the control signal applied from the detector circuit 34 to the first and third solenoid valves 44 and 48 changes to its low level to cause them to connect the first openings 44*a* and 48*a* to the third openings 44*c* and 48*c*, respectively. Thus, a high vacuum is conducted from the vacuum tank 36 through the first and second solenoid valves 44 and 46 and the conduit 50 to the working chamber 28*a* of the first valve actuator 28 to cause the stop valve 22 to close the second branch 12*b* substantially at the same time the engine is shifted from its full cylinder mode to its split cylinder mode. While, the high vacuum in the vacuum tank 36 is gradually conducted to the working chamber 30*a* of the second valve actuator 30 through the third solenoid valve 48 and the conduit 54 due to the provision of the orifice 52 in the trifurcated conduit branch leading to the first opening 48*a* of the third solenoid valve 48. As a result, the EGR valve 26 is gradually open to allow recirculation of exhaust gases into the second branch 12*b* after the stop valve 22 becomes fully open. This can eliminate the possibility of the recirculated exhaust gases from flowing into the first branch 12*a*.

During a split cylinder mode of operation, the EGR valve 26 is held fully open to allow recirculation of exhaust gases so as to suppress pumping loss in the second group of cylinders #4 to #6 and the stop valve 22 is held fully closed to prevent the recirculated exhaust gases from flowing into the first branch 12*a*.

When the engine is shifted from a split cylinder mode to a full cylinder mode, the control signal applied from the detector circuit 34 to the first and third solenoid valves 44 and 48 changes to its high level to cause them to connect the second openings 44*b* and 48*b* to the third openings 44*c* and 48*c*, respectively. Thus, atmospheric pressure is conducted through the third solenoid valve 48 and the conduit 54 to the working chamber 30*a* of the second valve actuator 30 to cause the EGR valve 26 to close the EGR passage 24 so as to stop exhaust gases from recirculating substantially at the same time the engine is shifted from its split cylinder mode to its full cylinder mode. Since the pressure developed in the second branch 12*b* is higher than that in the first branch 12*a* at this time, a low signal is applied to the second solenoid valve 46 from the detector circuit 34 to hold its third opening 46*c* connected to its first opening 46*a*. Thus, the high vacuum from the vacuum tank 36 is conducted to the working chamber 28*a* of the first valve actuator 28 to hold the stop valve 22 fully closed.

The exhaust gases recirculated and filled in the second branch 12*b* are gradually discharged to the exhaust passage 18 by the pumping function of the second group of cylinders #4 to #6 and the pressure in the second branch 12*b* gradually falls. When the pressure in the second branch 12*b* falls to a level equal to that in the first branch 12*a*, the vacuum operated switch 56 is turned on to provide a high signal to the second solenoid valve 46 which thereby makes a connection between the second and third openings 46*b* and 46*c*. Thus, atmospheric pressure is conducted through the first and second solenoid valve 44 and 46 and the conduit 50 to the working chamber 28*a* of the first valve actuator 28 to cause the stop valve 22 to fully open the second branch 12*b*. That is, the stop valve 22 becomes open when the exhaust gases recirculated and filled in the second branch 12*b* are discharged therefrom and the pressure in the second branch 12*b* becomes equal to that in the first branch 12*a*. This can prevent exhaust gases from flowing into the first branch 12*a* and can supply fresh air into the second group of cylinders, having been inoperative, without any trouble in engine operation.

There has been provided, in accordance with the present invention, an improved split type internal combustion engine which is free from any fuel combustion trouble resulting in a fuel economy penalty when the engine is shifted between its full and split cylinder modes of operation. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claim.

What is claimed is:

1. An internal combustion engine comprising:

(a) a plurality of cylinders split into first and second groups;

(b) an intake passage provided therein with a throttle valve and divided downstream of said throttle valve into first and second branches, said first branch communicating with said first group of cylinders, said second branch communicating with said second group of cylinders;

(c) an exhaust passage;

(d) first valve means provided in said second branch for opening and closing the same;

(e) an EGR passage having its one end opening into said second branch and the other end opening into said exhaust passage for recirculation of a portion of exhaust gases thereinto;

(f) second valve means provided in said EGR passage for opening and closing the same;

(g) a fuel injection control unit for providing, in synchronism with rotation of said engine, a drive pulse signal having its pulse width varying as a function of intake air flow rate;

(h) first and second fuel supply means responsive to the drive pulse signal for supplying fuel into said first and second groups of cylinders, respectively;

(i) a load detector responsive to engine load conditions for allowing application of the drive pulse signal to said first and second fuel supply means and providing a first control signal under high load conditions, and for allowing application of the drive pulse signal to said first fuel supply means but stopping application of the drive pulse signal to said second fuel supply means and providing a second control signal under low load conditions;

(j) first valve control means responsive to the first control signal from said load detector for opening said first valve means but holding said first valve means closed as long as the pressure in said second branch is substantially higher than the pressure in said first branch, said first valve control means responsive to the second control signal therefrom for closing said first valve means; and (k) second valve control means responsive to the first control signal from said load detector for closing said second valve means and responsive to the second control signal for opening said second valve means.

2. An internal combustion engine according to claim 1, wherein said first valve control means comprises:

(a) a valve actuator responsive to the first control signal from said load detector to assume a first state to cause said first valve means to open and responsive to the second signal therefrom to assume a second state to cause said first valve means to close;

(b) a pressure differential sensor responsive to the difference between the pressures developed in said first and second branches for providing a first signal when there is substantially no pressure differential therebetween and for providing a second signal when there is any pressure differential therebetween, and (c) preference means responsive to the second signal from said pressure differential sensor for having a preference to the second state of said first valve actuator.

3. An internal combustion engine according to claim 2, wherein said pressure differential sensor comprises a source of power, and a pressure operated switch for connecting said preference means to said power source when the pressure developed in said second branch is substantially equal to that in said first branch and for disconnecting said preference means from said power source when the pressure in said second branch is substantially higher than that in said first branch.

4. An internal combustion engine according to claim 3, wherein said pressure operated switch comprises a diaphragm positioned within a casing to form first and second working chambers, said first working chamber connected to said second branch, said second working chamber connected to said first branch, a movable contact mounted on the surface of said diaphragm facing said first working chamber, a pair of fixed contacts disposed in spaced relation in said first working chamber, one of said fixed contacts connected to said power source, the other fixed contact connected to said preference means, and a balance spring disposed within said second working chamber for urging said diaphragm toward said first working chamber so as to bring said movable contact into connection with said fixed contacts when the pressure in said second branch is substantially equal to that in said first branch.

5. An internal combustion engine according to claim 2, wherein said valve actuator comprises:

(a) A diaphragm unit having a diaphragm positioned within a casing to form a working chamber, means drivingly connecting said diaphragm to said first valve means, and a balance spring disposed within said working chamber for urging said diaphragm in a direction to cause said first valve means to open said first branch;

(b) a first solenoid valve having a first opening connected to a vacuum source, a second opening connected to atmospheric pressure, and a third opening; and (c) said first solenoid valve responsive to the first signal from said load detector for connecting its third opening to its second opening and responsive to the second signal therefrom for connecting its third opening to its first opening; and wherein said preference means comprises:

(a) a second solenoid valve having a first opening connected to said vacuum source, a second opening connected to said third opening of said first solenoid valve, and a third opening connected to said working chamber of said diaphragm unit; and (b) said second solenoid valve responsive to the first signal from said pressure differencial sensor for connecting its third opening to said second opening and responsive to the second signal therefrom for connecting its third opening to said first opening.

6. An internal combustion engine according to claim 1, wherein said second valve control means comprises:

(a) a diaphragm unit positioned within a casing to form a working chamber, means drivingly connecting said diaphragm to said second valve means, and a balance spring disposed within said working chamber for urging said diaphragm in a direction to cause said second valve means to close said EGR passage;

(b) a solenoid valve having a first opening connected to a vacuum source, a second opening connected to atmospheric air, and a third opening connected to said working chamber of said diaphragm unit; and (c) said solenoid valve responsive to the first signal from said load detector for connecting its third opening to its second opening and responsive to the second signal therefrom for connecting its third opening to its first opening.

7. An internal combustion engine according to claim 6, which further comprises delay means for gradually conducting vacuum from said vacuum source to said first opening of said solenoid valve.

8. An internal combustion engine according to claim 7, wherein said delay means comprises an orifice provided in the conduit leading from said vacuum source to said first opening of said solenoid valve.

* * * * *